US005320054A

United States Patent [19]

Asano

[11] Patent Number: 5,320,054

[45] Date of Patent: Jun. 14, 1994

[54] EMBROIDERY DATA PRODUCING APPARATUS FOR EMBROIDERY MACHINE

[75] Inventor: Fumiaki Asano, Nagoya, Japan

[73] Assignee: Brother Kogyo Kabushiki Kaisha, Nagoya, Japan

[21] Appl. No.: 849,961

[22] Filed: Mar. 12, 1992

[30] Foreign Application Priority Data

May 15, 1991 [JP] Japan ..... 3-139654

[51] Int. Cl.[5] ..... D05B 21/00; D05C 5/06

[52] U.S. Cl. ..... 112/121.12; 112/103

[58] Field of Search ..... 112/121.12, 103, 121.11, 112/445, 456, 457, 266.1, 102, 262.3; 364/470

[56] References Cited

U.S. PATENT DOCUMENTS 4,849,902 7/1989 Yokoe et al. ..... 112/121.12 X
5,054,408 10/1991 Hayakawa ..... 112/103 X
5,191,536 3/1993 Komuro et al. ..... 112/454 X

*Primary Examiner*—Peter Nerbun
*Attorney, Agent, or Firm*—Oliff & Berridge

[57] ABSTRACT

An embroidery data producing apparatus for an embroidery machine which forms embroidery stitches based on embroidery data has the ability to create an embroidery pattern having a uniform thickness without generating overstitched areas. The apparatus includes storage for embroidery data, a selecting mechanism for selecting embroidery data from storage which will generate an overstitched area and a changing mechanism for changing the selected embroidery data into data which will not generate the overstitched area.

20 Claims, 9 Drawing Sheets

| ITEM | INSTRUCTIONS |
|---|---|
| S500 | STORE PATTERN DATA |
| S501 | PRODUCE STITCH DATA |
| S502 | STORE STITCH DATA |
| S503 | STORE TOTAL EMBROIDERY STITCH NUMBER N |
| S504 | C←1 |
| S505 | DIVIDE EMBROIDERY AREA BY CTH STITCH |
| S506 | STORE TOTAL EMBROIDERY AREA NUMBER M |
| S507 | P←1 |
| S508 | CTH STITCH INCLUDED IN PTH AREA? |
| S509 | P←P+1 |
| S510 | P>M? |
| S511 | C←C+1 |
| S512 | C>N? |
| S513 | CTH STITCH SEWN BEFORE PTH AREA |
| S514 | DELETE STITCH DATA FOR FORMING CTH STITCH |

Fig.4B

| ITEM | INSTRUCTIONS |
|---|---|
| S500 | STORE PATTERN DATA |
| S501 | PRODUCE STITCH DATA |
| S502 | STORE STITCH DATA |
| S503 | STORE TOTAL EMBROIDERY STITCH NUMBER N |
| S504 | C←1 |
| S505 | DIVIDE EMBROIDERY AREA BY CTH STITCH |
| S506 | STORE TOTAL EMBROIDERY AREA NUMBER M |
| S507 | P←1 |
| S508 | CTH STITCH INCLUDED IN PTH AREA? |
| S509 | P←P+1 |
| S510 | P>M? |
| S511 | C←C+1 |
| S512 | C>N? |
| S513 | CTH STITCH SEWN BEFORE PTH AREA |
| S514 | DELETE STITCH DATA FOR FORMING CTH STITCH |

EMBROIDERY DATA PRODUCING APPARATUS FOR EMBROIDERY MACHINE

BACKGROUND OF THE INVENTION

1. Field of the Invention

The present invention relates to an embroidery data producing apparatus for an embroidery machine which is capable of forming an embroidery stitch based on embroidery data.

2. Description of Related Art

An embroidery data producing apparatus is disclosed in U.S. Pat. No. 4,849,902. According to the embroidery data producing apparatus, when an operator sets an embroidery area where embroidery stitches are to be formed and division lines are defined for dividing the embroidery area, the embroidery area is automatically divided into a plurality of blocks, and block data is converted into embroidery data. The block data has information about the vertexes of each block of the divided embroidery area. When the block data is supplied to an embroidery machine, the embroidery machine automatically creates stitch data based on the block data so as to form the embroidery stitches on the embroidery area. Therefore, the embroidery area is covered with a plurality of the embroidery stitches, so that an embroidery pattern is formed. The stitch data has information about sewing positions where the embroidery stitches are to be formed.

If an embroidery machine does not have a function for automatically creating the stitch data based on the block data, the stitch data is produced as the embroidery data based on the block data by an embroidery data producing apparatus, and the stitch data is supplied to the embroidery machine. Therefore, the embroidery data is equivalent to the block data or the stitch data.

U.S. Pat. No. 5,054,408 discloses an embroidery data producing apparatus which can compute block data from embroidery data. The embroidery data producing apparatus automatically sets a plurality of division lines for dividing an embroidery area on which a plurality of embroidery stitches are to be formed, based on an embroidery direction, and automatically divides the embroidery area. Therefore, according to the embroidery data producing apparatus, the operator need not set the division lines.

A conventional embroidery data producing apparatus can create embroidery data even if the embroidery area of one embroidery pattern is composed of a plurality of embroidery areas. However, it often happens that a plurality of embroidery areas mutually overlap. If the embroidery stitches are formed in accordance to the embroidery data created in such case, the overlap area where a plurality of embroidery areas mutually overlap is covered with the embroidery stitches a plurality of times or overstitched. For instance, an embroidery area 100 of a pattern shown in FIG. 9A comprises three embroidery areas 101, 102 and 103. The embroidery area 101 and the embroidery area 102 have an overlap area at an almost center position of each. FIG. 9B shows a plurality of embroidery stitches which are formed in accordance to the embroidery data which is created by the embroidery data producing apparatus. As shown in FIG. 9B, the overlap area where the embroidery area 101 and the embroidery area 102 overlap each other is covered twice with the embroidery stitches.

As described above, in the case that the embroidery stitches are formed in accordance to the embroidery data made by the conventional embroidery data producing apparatus, it is possible that an area is generated which is covered with embroidery stitches a plurality of times. The area which is covered with the embroidery stitches a plurality of times becomes thicker than the other area. Therefore, the appearance of the formed embroidery pattern becomes unsightly. The operator has to modify the embroidery data made by the embroidery data producing apparatus in order to prevent generation of the area covered with the embroidery stitches a plurality of times. In the case that the embroidery area is wide or there are many areas to be covered with embroidery stitches a plurality of times, it is very troublesome for the operator to modify the embroidery data. Moreover, it is possible that the operator may make a mistake while modifying the embroidery data.

SUMMARY OF THE INVENTION

An object of the present invention is to provide an embroidery data producing apparatus which can create embroidery data which are capable of forming a neat embroidery pattern.

An another object of the present invention is to provide an embroidery data producing apparatus which can create embroidery data which are capable of forming an embroidery pattern with a uniform thickness of the embroidery stitches.

Further, an object of the present invention is to provide an embroidery data producing apparatus which can create embroidery data which do not generate an overstitched area covered with embroidery stitches a plurality of times in an embroidery area.

To achieve the above and other objects, an embroidery data producing apparatus according to the present invention includes the following: embroidery data storage means for storing embroidery data for covering an embroidery area with embroidery stitches; selecting means for selecting embroidery data which generate an overstitched area in the embroidery area from the embroidery data stored in the embroidery data storage means; and changing means for changing the embroidery data selected by the selecting means into embroidery data which do not generate the overstitched area in the embroidery area.

In the embroidery data producing apparatus of the present invention, the embroidery data storage means stores embroidery data which is utilized to form a embroidery pattern by covering an embroidery area with embroidery stitches. The selecting means selects embroidery data which generate an overstitched area if the stitches are formed in accordance with the embroidery data stored in the embroidery data storage means. The changing means changes the embroidery data selected by the selecting means into embroidery data which do not generate the overstitched area.

According to the present invention, embroidery data which generate an overstitched area are selected by the selecting means and changed into embroidery data which do not generate the overstitched area. Therefore, the embroidery data producing apparatus can create embroidery data which do not generate an overstitched area. Moreover, according to the embroidery data producing apparatus of the present invention, a neat embroidery pattern with an uniform thickness of embroidery stitches can be formed.

BRIEF DESCRIPTION OF THE DRAWINGS

Preferred embodiments of the present invention will be described in detail with reference to the following figures wherein:

FIGS. 4A and 4B are a flowchart and a table showing an embroidery data creating program stored in the ROM of the embroidery data producing apparatus;

DETAILED DESCRIPTION OF THE PREFERRED EMBODIMENTS

Figure 1:
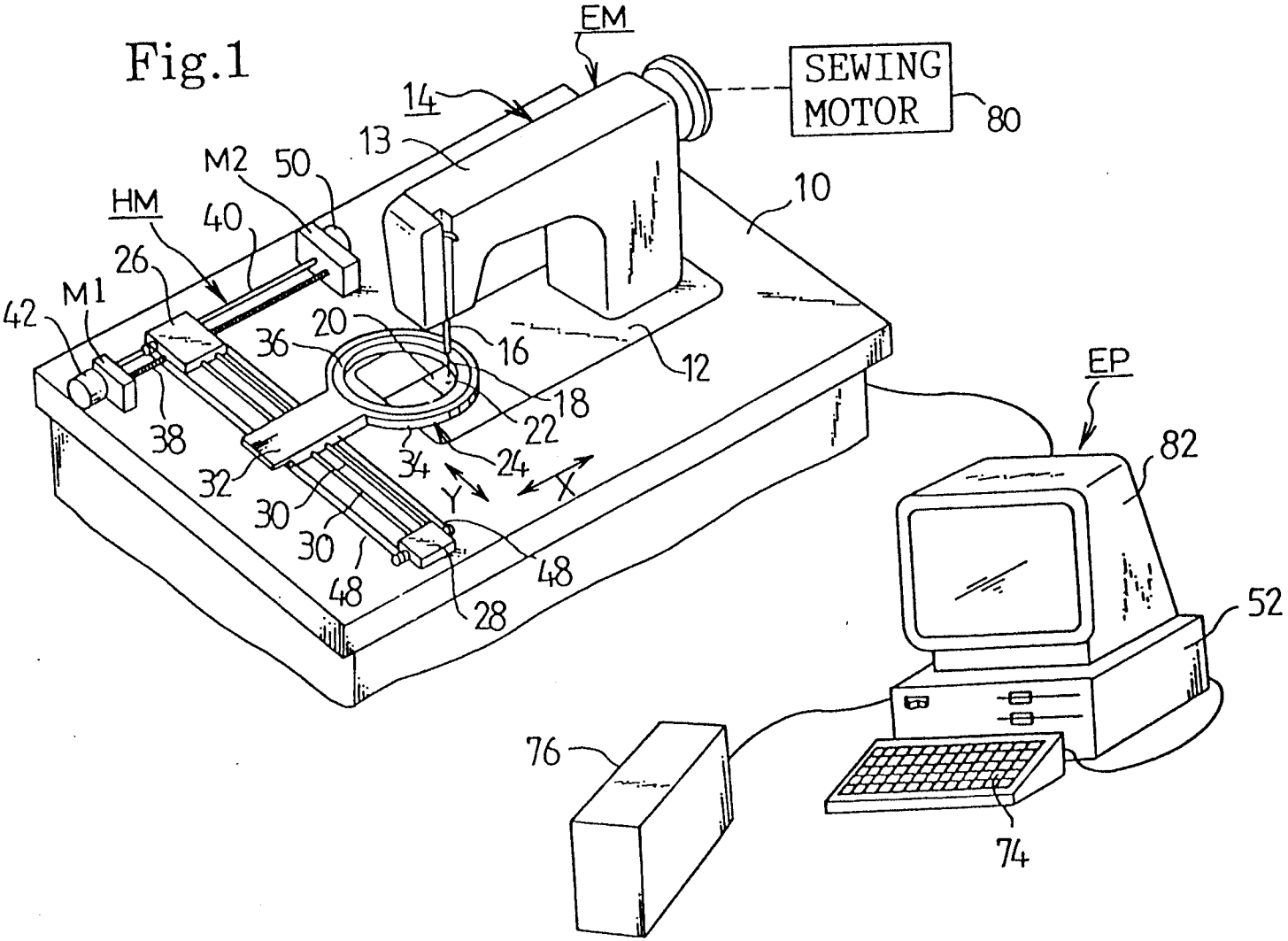
FIG. 1 is a perspective view showing an embroidery data producing apparatus and an embroidery machine of one embodiment of the present invention.

As shown in FIG. 1, a main body 14 of an embroidery machine EM is built in a table 10. The main body 14 includes a bed 12 and an arm 13. A needle bar 16 having a needle 18 is reciprocably supported by a head portion of the arm 13. The needle bar 16 is moved vertically by a sewing motor 80 shown in FIG. 2. An opening on the bed 12 is covered with a throat plate 20. A needle hole 22 where the needle 18 pierces is formed on the throat plate 20.

An embroidery frame 24 for holding a work fabric is mounted on the table 10. The embroidery frame 24 has an outer frame 34 having an annular shape and an inner frame 36 which has an annular shape and is detachably mounted in the outer frame 34. The work fabric is stretched on the inner frame 36 by being held between the outer frame 34 and the inner frame 36.

The embroidery frame 24 can be moved to any position relative to the table 10, to locate a sewing position beneath the needle 18, by a horizontal moving mechanism HM. The horizontal moving mechanism includes a slide plate 32 integrally provided from a sector of the outer frame 34. The slide plate 32 is slidably supported by two slide bars 30 which are provided between support stands 26, 28 and extend in a Y axis direction shown by an arrow Y. Motor installation stands M1, M2 are provided on the table 10. A feeding screw 38 is rotatably supported between the motor installation stands M1, M2 and extends in a X axis direction which is orthogonal to the Y axis direction and is shown by an arrow X. The support stand 26 is engaged to the feeding screw 38. The feeding screw 38 is driven to rotate by an X axis feeding motor 42 provided on the motor installation stand M1. Therefore, when the feeding screw 38 is driven and rotated by the X axis feeding motor 42, the embroidery frame 24, as well as the support stands 26, 28 and the slide bars 30, are moved along the X axis direction.

A rotation transmitting shaft 40, extending in the X axis direction, is also rotatably supported between the motor installation stands M1, M2. The rotation transmitting shaft 40 is driven to rotate by the Y axis feeding motor 50 provided on the motor installation stand M2. The rotation transmitting shaft 40 drives wires 48 mounted between the support stands 26 and 28. The slide plate 32 is fixed to the wires 48. Therefore, when the rotation transmitting shaft 40 is rotated by the Y axis feeding motor 50, the embroidery frame 24 is moved along the Y axis direction by the wires 48 and 48. As described above, the work fabric set in the embroidery frame 24 can therefore be moved to any position relative to the table 10 to properly locate the sewing position by the X axis feeding motor 42 and the Y axis feeding motor 50 of the horizontal moving mechanism HM.

The embroidery machine EM is connected to an embroidery data producing apparatus EP. The embroidery data producing apparatus EP controls the embroidery machine EM in accordance with the embroidery data while making the embroidery data. The embroidery data producing apparatus EP includes a control device 52, a keyboard 74, an external memory device 76 and a display 82.

Figure 2:
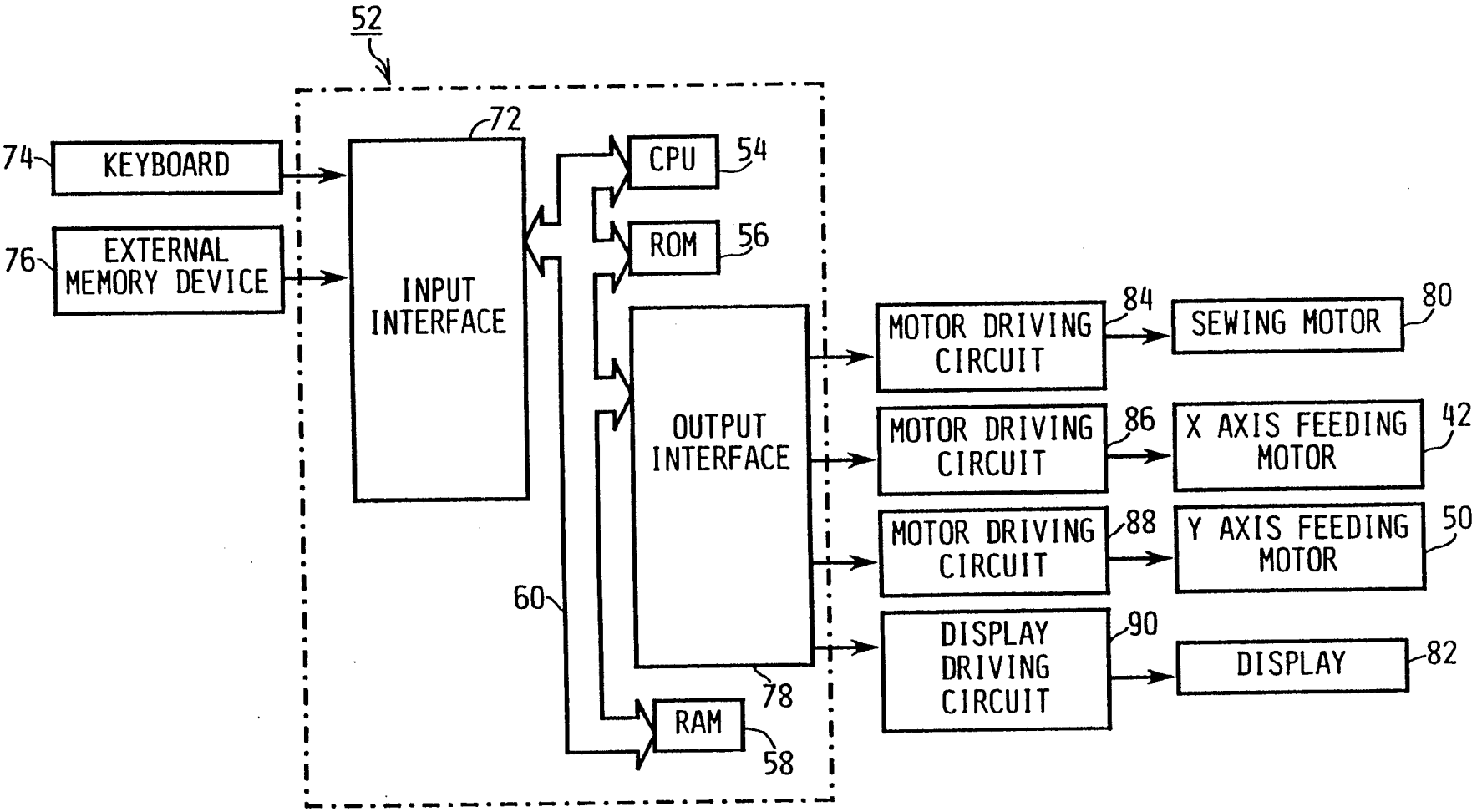
FIG. 2 is a block diagram schematically showing the embroidery data producing apparatus and the embroidery machine.
Figure 3:
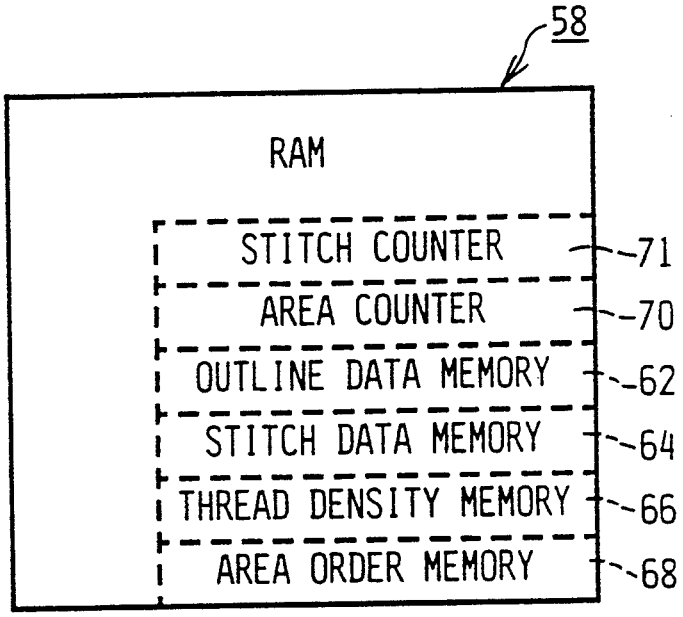
FIG. 3 is an explanatory schematic view explaining the memory area in RAM of the embroidery data producing apparatus.
Figure 4A:
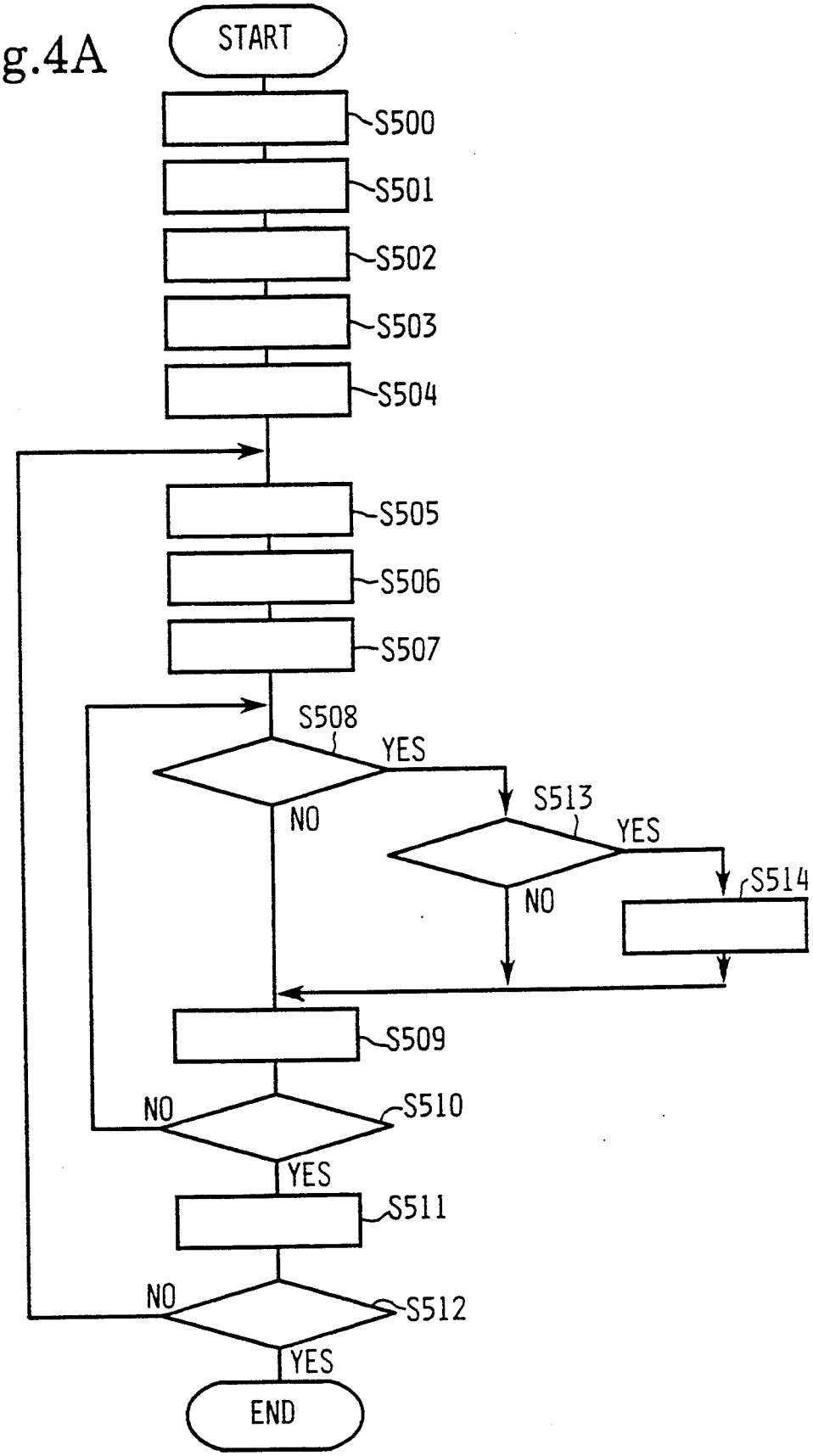

As shown in FIG. 2, the control device 52 has a computer consisting of CPU 54, ROM 56, RAM 58, an input interface 72 and an output interface 78 which are connected to one another through a bus 60. An embroidery data making program shown by the flowchart in FIG. 4A and the table in FIG. 4B is stored in the ROM 56. As shown in FIG. 3, an outline data memory 62, a stitch data memory 64, a thread density memory 66 and an area order memory 68 are included in the RAM 58. Further, an area counter 70 and a stitch counter 71 are included in the RAM 58.

Outline data representing an outline of an embroidery pattern is stored in the outline data memory 62. That is, the outline data represents the outline of an embroidery area to be covered with a plurality of embroidery stitches. The stitch data is stored in the stitch data memory 64 as the embroidery data. The stitch data represents sewing positions of the embroidery stitches which form the embroidery pattern. A thread density of the embroidery stitches to be formed on the embroidery area is stored in the thread density memory 66. An area order which represents a sewing order of the embroidery area is stored in the area order memory 68. Therefore, in the case that the embroidery area of one embroidery pattern is composed of a plurality of embroidery areas, the outline data of a plurality of embroidery areas is stored in the outline data memory 62, and the sewing order of a plurality of embroidery areas is stored in the area order memory 68. A count C for representing the embroidery area is stored in the area counter 70. A count value P for representing the embroidery stitch to be formed in accordance with the stitch data is stored in the stitch counter 71.

The keyboard 74 and the external memory device 76 are connected to the input interface 72 of the control device 52. The pattern data for a plurality of embroidery patterns are stored beforehand in the external memory device 76. The pattern data have the above-mentioned outline data, the thread density and the area order. The keyboard 74 has many keys, such as, alphabet keys, numeral keys, symbol keys, Japanese syllabary keys, or the like. The keyboard 74 is useful to select desired pattern data out of the pattern data for a plurality of the embroidery patterns stored in the external memory device 76. The keyboard 74 is also useful to input the pattern data into the control device 52.

The outline data which represents the outline of the embroidery area has information about the coordinate values which represent a plurality of characteristic points on the outline of the embroidery area, such as vertexes or points on a curve. In such a case, the outline of the embroidery area is approximated by the straight line which connects the characteristic points in the predetermined order. For example, if the outline of the embroidery area is approximated by a curve which connects the characteristic points in the predetermined order, the outline data has information about the coordinate values of the characteristic points and the coordinate values of a control point for representing a curve which connects the adjoining characteristic points. If the embroidery area is a circle, the outline data may have information about the coordinate values of three points on the circle and the data which represent that the outline is a circle. Moreover, if the embroidery area is a ring shape, the outline data may have information about the coordinate values of three points on an outer line, the coordinate values of one point on an inner line and the data which represent that the two outlines are circles. Also, an embroidery starting point and an embroidery ending point in the embroidery area are set beforehand.

Motor drive circuits 84, 86 and 88 for driving the above-mentioned sewing motor 80, X axis feeding motor 42, and Y axis feeding motor 50 are connected to the output interface 78. Moreover, a display drive circuit 90 for driving the display 82 is connected to the output interface 78 of the control device 52. The display 82 displays the embroidery pattern in accordance with the embroidery data while displaying the outline of the embroidery area based on the outline data.

Next, an embroidery making processing of the present invention will be explained with reference to the flowchart and table in FIGS. 4A and 4B showing the embroidery data creating program. The embroidery data creating process is executed according to the embroidery data creating program stored in the ROM 56 by the CPU 54. First, when an operator selects a pattern data of a desired embroidery pattern out of pattern data of a plurality of embroidery patterns stored in the external memory device 76 through the keyboard 74, the selected pattern data are stored in the RAM 58 (Step 500, hereinafter shown as S500). The pattern data have an outline data, an area order and a thread density. Therefore, the outline data, the area order and the thread density in the selected pattern data are stored in the outline data memory 62, the thread density memory 66 and the area order memory 68 in the RAM 58, respectively.

Figure 5B:
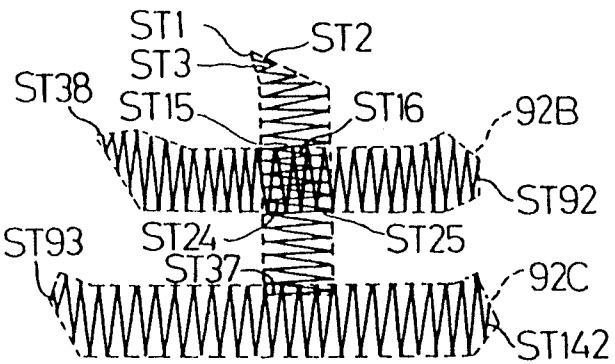
FIG. 5A through FIG. 5D are explanatory views explaining each step in creating the embroidery data in the execution of the embroidery data creating program.
Figure 5A:
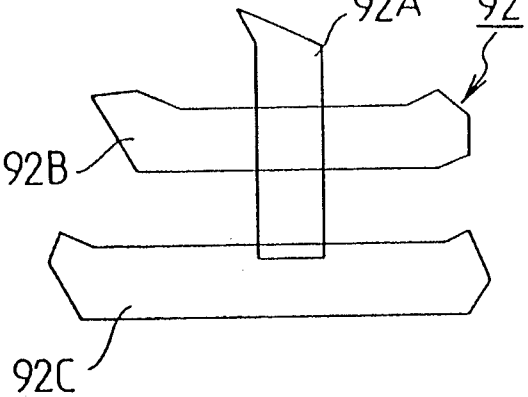

Hereinafter, an example of the pattern data for a pattern "±" shown in FIG. 5A selected from the embroidery data will be explained. As shown in FIG. 5A, the embroidery area of the pattern "±" 92 is composed of three embroidery areas 92A, 92B and 92C. The embroidery areas 92A, 92B and 92C are sewn in order of embroidery area 92A, embroidery area 92B and embroidery area 92C. Therefore, the pattern data of the pattern 92 have the outline data representing each outline of the embroidery areas 92A, 92B and 92C, the area order representing the sewing order for the embroidery areas 92A, 92B and 92C, and the thread density. The area order is shown by the numbers given to the embroidery areas 92A, 92B and 92C. Since the embroidery areas 92A, 92B and 92C are sewn in consecutive order, the embroidery area 92A, the embroidery area 92B and the embroidery area 92C are given numbers 1, 2 and 3, respectively.

Next, the stitch data are created. The stitch data represent the sewing positions of the embroidery stitches to be formed in accordance with the pattern data stored in the RAM 58 (S501). Therefore, the stitch data representing the sewing positions of the embroidery stitches which cover the embroidery area 92A, 92B and 92C are created. Since the various methods to make the stitch data in accordance with the pattern data are known, any method may be used. In the present embodiment, the stitch data making method disclosed in U.S. Pat. No. 5,054,408 is used, which is incorporated herein by reference. FIG. 5B shows the embroidery stitches formed in accordance with the stitch data created in S501. The embroidery stitches in FIG. 5B are very easy to see because adjoining embroidery stitches are separated from each other. In other words, FIG. 5B shows an embroidery pattern which has a very low thread density. However, in an actual embroidery pattern, the thread density is set such that adjoining embroidery stitches come in contact with each other.

The stitch data created in S501 are stored into the stitch data memory 64 of the RAM 58 in the sewing order (S502). Next, the total embroidery stitch number N to be formed in accordance with the stitch data stored in the stitch data memory 64 is calculated and is stored in the RAM 58 (S503). Therefore, stitch data from the first stitch (ST1) to the 37th stitch (ST37) on the embroidery area 92A, stitch data from the 38th stitch data (ST38) to the stitch 92nd (ST92) on the embroidery area 92B and stitch data from the 93th stitch (ST93) to the 142nd stitch (ST142) on the embroidery area 92C are stored into the stitch data memory 64 in order. These embroidery stitches are shown in FIG. 5B. And a number 142 is stored in the RAM 58 as the total number of embroidery stitches.

A count value C of the stitch counter 71 which represents a number given to the embroidery stitch is set to be 1 (S504), and the embroidery area on which the Cth stitch is formed is divided by an embroidery stitch represented by a count value C of the stitch counter 71, that is, the Cth stitch. In the case that the embroidery area is divided, the embroidery area is increased by one. Therefore, an area order of the embroidery area stored in the area order memory 68 is changed (S505). In the case that the count value C of the stitch counter 71 is 1, the embroidery area 92A is not divided because the first stitch (ST1) exists on the outline of the embroidery area 92A as shown in FIG. 5B. In the case that the count value C of the stitch counter 71 is 2, the embroidery area 92A on which the second stitch (ST2) is formed is divided by the second stitch (ST2). In a such case, the second stitch (ST2) divides the embroidery area 92A into two embroidery areas. One embroidery area is sewn by the embroidery stitch before the second stitch (ST2) is formed. The other embroidery area is sewn by the embroidery stitch after the second stitch (ST2) is formed, and the area order stored in the area order memory 68 is changed so that the number given to the embroidery area which is sewn by the embroidery stitch before the second stitch is formed becomes 1, the number given to the embroidery area which is sewn by the embroidery stitch after the second stitch is formed becomes 2, the number given to the embroidery area 92B becomes 3 and the number given the embroidery area 92C becomes 4.

The total embroidery area number M counting the divided embroidery areas is stored in the RAM 58 (S506). If the count value C of the stitch counter 71 is 1, the total embroidery area number M is 3 because the first stitch (ST1) shown in FIG. 5B does not divide the embroidery area 92A. If the count value C of the stitch counter 71 is 2, the embroidery area 92A is divided by the second stitch 2 (ST2). Therefore, the total embroidery area number M is 4. Next, a count value P of the area counter 70 which represents a number given to the embroidery area is set to be 1 (S507).

In S508, the CPU 52 determines whether the Cth stitch is formed in the embroidery area represented by the count value P of the area counter 70, that is, the Pth area. In other words, an inside or outside determination of the Cth stitch for the Pth area is executed. The method of the inside or outside determination is explained below. A formula for determining whether one point exists on the right side or the left side of a line is well-known. If the point exists on same side for all lines representing the outline of an area, the CPU 52 can determine that the point exists in the area. Therefore, the CPU 52 determines whether some points on the Cth stitch exist in the Pth area. If all points on the Cth stitch exist in the Pth area, the CPU 52 can determine that the Cth stitch exists in the Pth area. In the present embodiment, it is predetermined that the CPU 52 determines that the Cth stitch on the outline of the Pth area does not exist in the Pth area. Also, it is predetermined that the CPU 52 determines that the Cth stitch which exists partly in the Pth area, that is, the Cth stitch which crosses the outline of the Pth area, does not exist in the Pth area. If the count value C of the stitch counter 71 is 1 and the count value P of the area counter 70 is 1, the CPU 52 determines in S508 whether the first stitch (ST1) shown in FIG. 5B exists in the embroidery area 92A which is the first area. Since the first stitch (ST1) exists on the outline of the embroidery area 92A, the CPU 52 determines "NO" and goes to S509.

The count value P of the area counter 70 is increased by only one in S509, and the CPU 52 determines whether the count value P of the area counter 70 is more than the total embroidery area number M or not in S510. That is, the CPU 52 determines whether the inside or outside determination of the Cth stitch for all embroidery areas is executed or not. If the CPU 52 determines "YES" in S510, the CPU 52 goes to S511. If the CPU 52 determines "NO" in S510, the CPU 52 returns to S508. In the case that the CPU 52 determines that the first stitch (ST1) shown in FIG. 5B does not exist in the embroidery area 92A, which is the first area in S508, the count value P of the area counter 70 is changed from 1 to 2. The count value 2 of the area counter 70 is less than the total 3 of the embroidery area, and the CPU 52 determines "NO" in S510 and returns to S508.

Since the count value P of the area counter 70 is 2 in S508, the CPU 52 determines whether the first stitch (ST1) exists in the embroidery area 92B, which is the second area. Since the first stitch (ST1) does not exist in the embroidery area 92B, the CPU 52 determines "NO" in S508, and in S509, the count value P of the area counter 70 is changed from 2 to 3. Since the count value 3 of the area counter 70 is not more than the total embroidery area number 3, the CPU 52 determines "NO" in S510 and returns to S508. And in S508, the CPU 52 determines whether the first stitch (ST1) exists in the embroidery area 92C which is the third area. Since the first stitch (ST1) does not exist in the embroidery area 92C, the CPU 52 determines "NO" in S508, and in S509, the count value P of the area counter 70 is changed from 3 to 4. Since the count value 4 of the area counter 70 is more than the total embroidery area number 3, the CPU 52 determines "YES" in S510 and goes to S511. That is, the CPU 52 determines that the inside or outside determination of the first stitch (ST1) for all embroidery areas is completed.

The count value C of the stitch counter 71 is increased by only one in S511, and the CPU 52 determines whether the count value C of the stitch counter 71 is more than the total embroidery stitch number N in S512. That is, the CPU 52 determines whether the inside or outside determination of all embroidery stitches is executed. If the CPU 52 determines "YES" in S512, the embroidery data creating process is ended. If the CPU 52 determines "NO" in S512, the CPU 52 returns to S505. In the case that the CPU 52 determines that the inside or outside determination of the first stitch (ST1) shown in FIG. 5B for all embroidery areas is completed in S510, the count value C of the stitch counter 71 is changed from 1 to 2 in S511. Since the count value 2 is less than the total embroidery stitch number 142, the CPU 52 determines "NO" in S512 and returns to S505.

Since the count value C of the stitch counter 71 is 2 in S505, the embroidery area 92A on which the second stitch (ST2) is formed is divided by the second stitch (ST2). In such a case, the second stitch (ST2) divides the embroidery area 92A into two embroidery areas. One embroidery area is sewn by the embroidery stitch before the second stitch (ST2) is formed. The other embroidery area is sewn by the embroidery stitch after the second stitch (ST2) is formed, and the area order stored in the area order memory 68 is changed so that the number given to the embroidery area which is sewn by the embroidery stitch before the second stitch is formed becomes 1, the number given to the embroidery area which is sewn by the embroidery stitch after the second stitch is formed becomes 2, the number given to the embroidery area 92B becomes 3 and the number given to the embroidery area 92C becomes 4. Next, a number 4, as the total embroidery area number M counting the divided embroidery areas is stored in the RAM 58 (S506). The count value P of the area counter 70 representing the number given to the embroidery area is set to be 1 (S507).

The CPU 52 determines whether the second stitch (ST2) exists in the first area in S508. Since the second stitch (ST2) exists on the boundary line of the first area, that is, on the outline of the first area, the CPU 52 determines "NO" and goes to S509. In S509, the count value 2 of the area counter 70 is changed from 1 to 2. Since the count value 2 of the area counter 70 is less than the total embroidery area number 4, the CPU 52 determines "NO" in S510 and returns to S508, and since in S508 the CPU 52 determines whether the second stitch (ST2) exists on the boundary line of the second area, that is, on the outline of the second area, the CPU 52 determines "NO" and goes to S509. The count value P of the area counter 70 is changed from 2 to 3 in S509. Since the count value 3 of the area counter 70 is less than the total embroidery area number 4 in S510, the CPU determines "NO" and returns to S508.

The CPU 52 determines whether the second stitch (ST2) exists in the embroidery area 92B, which is the third area in S508. Since the second stitch (ST2) does not exist in the embroidery area 92B, the CPU 52 determines "NO" in S508, and the count value P of the area counter 70 is changed from 3 to 4 in S509. Since the count value 4 of the area counter 70 is not more than the total embroidery area number 4, the CPU 52 determines "NO" in S510 and returns to S508. The CPU 52 determines whether the second stitch (ST2) exists in the embroidery area 92C, which is the fourth area in S508. Since the second stitch (ST2) does not exist in the embroidery area 92C, the CPU 52 determines "NO" in S508, and the count value P of the area counter 70 is changed from 4 to 5 in S509. Since the count value 5 of the area counter 70 is more than the total embroidery area number 4, the CPU 52 determines "YES" in S510 and goes to S511. In S511, the count value C of the stitch counter 71 is changed from 2 to 3. Since the count value 3 of the stitch counter 71 is less than the total embroidery stitch number 142, the CPU 52 determines "NO" in S512 and returns to S505, and a similar processing is executed for the third stitch (ST3). The CPU 52 determines "NO" in S508 for the determinations from the third stitch (ST3) to the 15th stitch (ST15) in S508.

In the case that the count value C of the stitch counter 71 is 16 in S505, the embroidery area 92A is divided by the 16th stitch (ST16). In such a case, the 16th stitch (ST16) divides the embroidery area 92A into two embroidery areas. One embroidery area is sewn by the embroidery stitch before the 16th stitch (ST16) is formed. The other embroidery area is sewn by the embroidery stitch after the 16th stitch (ST16) is formed, and the area order stored in the area order memory 68 is changed so that the number given to the embroidery area which is sewn by the embroidery stitch before the 16th stitch (ST16) is formed becomes 1, the number given to the embroidery area which is sewn by the embroidery stitch after the 16th stitch (ST16) is formed becomes 2, the number given to the embroidery area 92B becomes 3 and the number given to the embroidery area 92C becomes 4. In the case that the count value P of the area counter 70 is 1 or 2, the 16th stitch (ST16) does not exist in the first area and the second area. Therefore, the CPU determines "NO" in S508. However, when the count value 3 of the area counter 70 is 3, the 16th stitch (ST16) exists in the embroidery area 92B which is the third area. Therefore, the CPU 52 determines "YES" in S508 and goes to S513.

In S513, the CPU 52 determines whether the Cth stitch is formed before the Pth area is sewn. If the CPU 52 determines "YES" in S513, the CPU 52 goes to S514, and after the stitch data for forming the Cth stitch is deleted in the stitch data memory 64 of the RAM 58 in S514, the CPU 52 goes to the above-mentioned S509. In the case that the CPU 52 determines that the 16th stitch (ST16) shown in FIG. 5B exists in the third area and determines "YES" in S508, the CPU 52 determines whether the 16th stitch (ST16) is formed before the third area is sewn in S513. Since the 16th stitch (ST16) is formed before the embroidery area 92B, which is the third area, is sewn, the CPU 52 determines "YES" in S513, and the CPU 52 deletes the stitch data for forming the 16th stitch (ST16) in the stitch data memory 64 in S514. In a similar manner as described above, the CPU 52 deletes the stitch data for forming the embroidery stitches which are from the 16th stitch (ST16) to the 24th stitch (ST24) shown in FIG. 5B in the stitch data memory 64 in S514. Thus, the stitch data stored in the stitch data memory 64 is changed to the stitch data for forming the stitch STCR1 between the 15th stitch (ST15) and the 25th stitch (ST25) shown in the two-dot chain line of FIG. 5C.

Figure 5D:
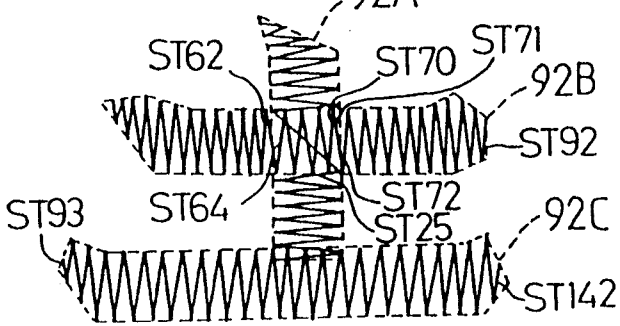

Afterwards, the CPU 52 determines "NO" for the judgements from the 25th stitch (ST25) to the 63th stitch (ST63) shown in FIG. 5D. Therefore, the stitch data stored in the stitch data memory 64 is not changed. Since the stitches from the 64th stitch (ST64) to the 70th stitch (ST70) exist in the embroidery area 92A, the CPU 52 determines "YES" in S508. However, since these stitches from the 64th stitch (ST64) to the 70th stitch (ST70) are formed after the embroidery area 92A, which is the first area, is sewn, the CPU 52 determines "NO" in S513. Therefore, the stitch data stored in the stitch data memory 64 is not changed. Since the CPU 52 determines "NO" for the determinations from the 71st stitch (ST71) to the 142nd stitch (ST142) in S508, the stitch data stored in the stitch data memory 64 is not changed. After the inside or outside determination of the 142nd stitch (ST142) is completed, the count value C of the stitch counter 71 is changed from 142 to 143 in S511. Since the count value 143 of the stitch counter 71 is more than the total embroidery stitch number 142, the CPU 52 determines "YES" in S512 and the embroidery data making processing is ended.

FIG. 5D shows an embroidery pattern formed in accordance with the stitch data made by the above-mentioned embroidery data creating process. As shown in FIG. 5D, the area on which the embroidery area 92A and the embroidery area 92B overlap each other is covered only once with the embroidery stitches. Therefore, the embroidery data producing apparatus EP of the present embodiment can automatically make stitch data into embroidery data. In accordance with the stitch data, an embroidery pattern with a uniform thickness of the embroidery stitches can be formed. Therefore, a neat embroidery pattern can be formed.

Further, according to the embroidery data producing apparatus EP of the present invention, if there is an area to be covered with embroidery stitches a plurality of times in accordance with the stitch data, the stitch data for forming the embroidery stitches which cover the area are deleted before the embroidery stitches which lastly cover the area are made. Therefore, one stitch is formed instead of the omitted embroidery stitches, that is, the stitch STCR1 shown in FIG. 5C which does not appear on the surface of the embroidery patter. Thus, a neat embroidery pattern is formed.

Figure 5C:
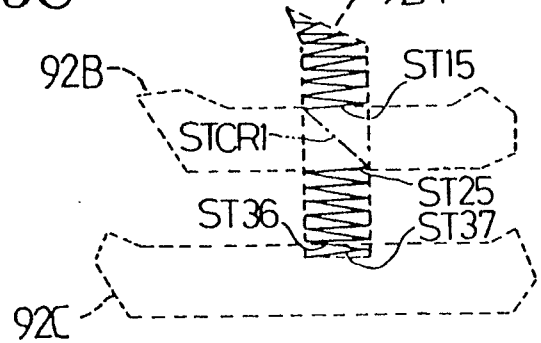

Moreover, according to the embroidery data producing apparatus EP of the present invention, if the Cth stitch exists partly in the Pth area, that is, the Cth stitch crosses the outline of the Pth area, it is predetermined that the CPU 52 will determine that the Cth stitch does not exist in the Pth area in the inside or outside determination in S508. Therefore, the stitch data for forming the Cth stitch which crosses the outline of the Pth area is not deleted. For instance, the 15th stitch (ST15) and the 25th stitch (ST25) shown in FIG. 5C are not omitted because the CPU 52 determines that they do not exist in the embroidery area 92B, which is the third area. The 36th stitch (ST36) is not omitted because the CPU 52 determines that the 36th stitch (ST36) does not exist in the embroidery area 92C, which is the fourth area.

Therefore, the embroidery stitches which cross the boundary line of the areas on which a plurality of embroidery areas overlap are formed without fail. Therefore, a neat embroidery pattern is formed without spaces in vicinity of the boundary line.

This invention is not limited to the above-mentioned embodiment. It should be understood that many changes and modifications may be made in the embodiment without departing from the scope of the present invention.

Figure 6:
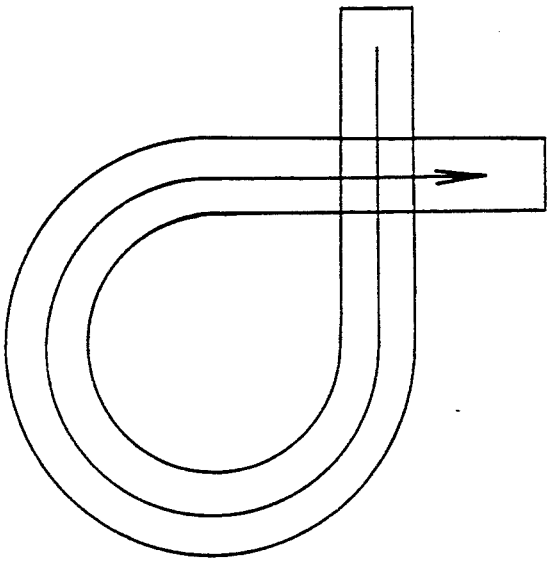
FIG. 6 is an explanatory view showing an example of pattern data of the present invention.
Figure 7:
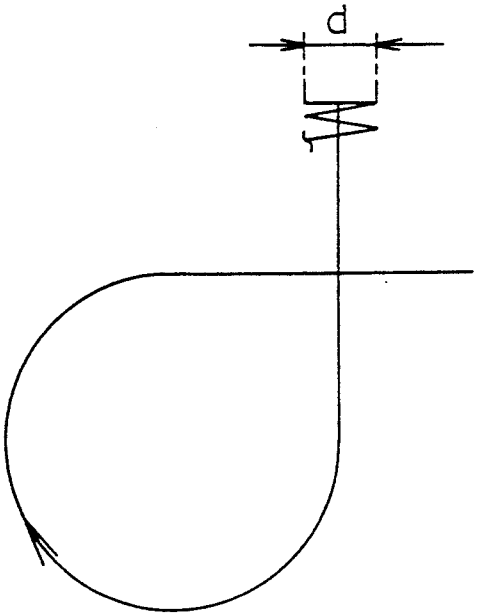
FIG. 7 is an explanatory view showing an another example of pattern data of the present invention.
Figure 8:
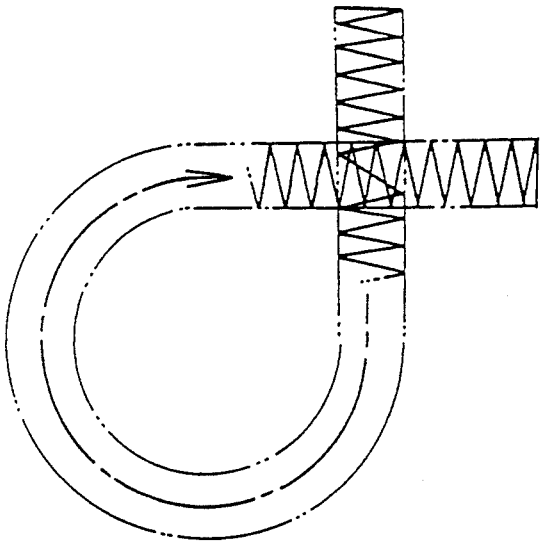
FIG. 8 is an explanatory view showing an embroidery pattern made in accordance with the embroidery data which are created based on the examples of the pattern data.
Figure 9B:
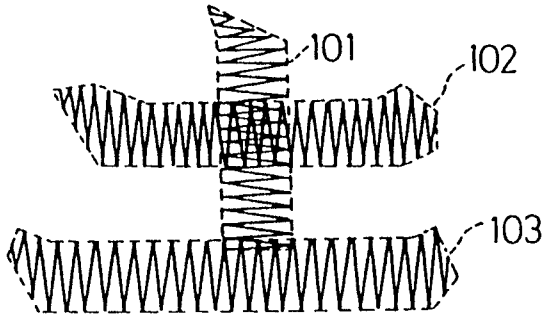
Fig.9B RELATED ART
FIG. 9A and FIG. 9B are explanatory views showing the embroidery pattern which is made in accordance with the embroidery data made by a conventional embroidery data producing apparatus.
Figure 9A:
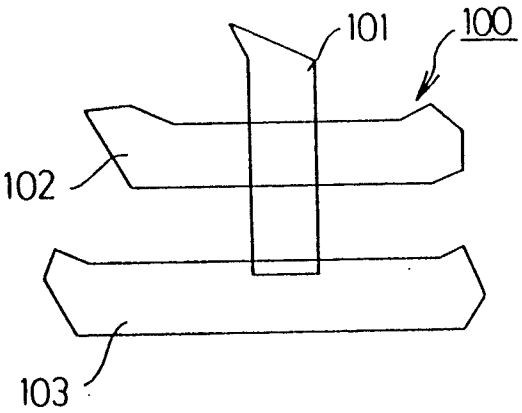
Fig.9A RELATED ART

For instance, in the above-mentioned embodiment, the pattern data has the outline data representing a plurality of embroidery areas, the area order and the thread density. However, as shown in FIG. 6, the pattern data may have an outline data representing one embroidery area having an overlapped area, an embroidery direction and the thread density. Moreover, as shown in FIG. 7, the pattern data may have an embroidery locus having a plurality of crossing points, a length d of the embroidery stitch and the thread density. According to the present invention, even if the pattern data is made as shown in FIG. 6 or FIG. 7, the stitch data capable of preventing the area to be covered with embroidery stitches a plurality of times can be created and the embroidery pattern shown in FIG. 8 can be made.

Further, in the above-mentioned embodiment, the CPU 52 determines that the Cth stitch which exists partly in the Pth area does not exist in the Pth area, so that the stitch data for forming the Cth stitch is not changed. In a such case, the Cth stitch is composed of two parts, one part exists in the Pth area and the other part does not exist in the Pth area. However, in the case that the Cth stitch exists partly in the Pth area, the stitch data for forming the Cth stitch may be changed so that the part of the Cth stitch which exists in the Pth area is not formed. In other words, the part of the Cth stitch which exists in the Pth area is deleted.

In addition, in the above-mentioned embodiment, a sewing position is not set in the area on which the embroidery stitches are deleted. However, if the area on which the embroidery stitches are deleted is relatively wide, it is possible that the cloth of the area on which the embroidery stitches are deleted will shrink. Therefore, the stitch data may be changed so that some sewing positions are set in the area on which the embroidery stitches are deleted in order to prevent the cloth from shrinking.

Moreover, in the above-mentioned embodiment, the stitch data is created as the embroidery data. However, a block data may be made as the embroidery data. In the case that the block data is made as the embroidery data, a plurality of embroidery areas represented by the outline data are divided into a plurality of blocks by the well-known method, and the CPU determines whether each block has a part which exists in each embroidery area. If the CPU determines that the block has a part which exists in the embroidery area, the CPU determines whether the block is sewn before the embroidery area is sewn. If the CPU determines that the block is sewn before the embroidery area is sewn, the block data representing the block may be changed so that the part which is exists in the embroidery area is deleted.

What is claimed is:

1. An embroidery data producing apparatus controlling an embroidery machine that forms embroidery stitches based on electrical signals representative of embroidery data, said embroidery data producing apparatus comprising:

embroidery data storage means for storing electrical signals representative of embroidery data for covering an embroidery area with embroidery stitches;

selecting means for selecting electrical signals representative of embroidery data from the electrical signals stored in said embroidery data storage means which result in an overstitched area; and changing means for changing the electrical signals selected by said selecting means into electrical signals representative of embroidery data which do not result in the overstitched area.

2. The embroidery data producing apparatus as in claim 1, wherein the changing means deletes electric signals representative of embroidery data which result in the overstitched area.

3. The embroidery data producing apparatus as in claim 1, wherein the changing means changes electrical signals representative of embroidery data relating to stitch length of stitches which are partially located in an overstitched area.

4. The embroidery data producing apparatus as in claim 1, wherein said changing means changes electrical signals representative of a first portion of the embroidery data and allows electrical signals representative of a second portion of the embroidery data adjacent an edge of the overstitched area to remain unchanged.

5. An embroidery data producing apparatus controlling an embroidery machine that forms embroidery stitches based on electrical signals representative of embroidery data, said embroidery data producing apparatus comprising:

sewing order storage means for storing sewing order of an embroidery area to be covered with embroidery stitches;

producing means for producing electrical signals representative of embroidery data based on the sewing order stored in said sewing order storage means; and prohibiting means for prohibiting said producing means from producing electrical signals representative of embroidery data which result in an overstitched area.

6. The embroidery data producing apparatus as in claim 5, wherein said prohibiting means partially prohibits said producing means from producing the electrical signals representative of embroidery data which result in the overstitched area and allows said producing means to produce electrical signals representative of a portion of embroidery data adjacent an edge of the overstitched area.

7. An embroidery data producing apparatus producing electrical signals representative of stitch data that define an embroidery stitch, said embroidery data producing apparatus comprising:

outline data storage means for storing electrical signals representative of sets of outline data, each set of outline data defining an outline of an embroidery area to be covered with embroidery stitches;

area order storage means for storing electrical signals representative of an area order corresponding to a sewing order of the embroidery areas;

stitch data producing means for producing electrical signals representative of sets of stitch data based on the electrical signals stored in said outline storage means, each set of electrical signals representative of stitch data defining embroidery stitches for covering each embroidery area;

stitch data storage means for storing the electrical signals representative of sets of stitch data produced by said stitch data producing means;

selecting means for selecting sets of embroidery stitches which are to be formed in the same embroidery area, based on the electrical signals representative of stitch data stored in said stitch data storage means and the electrical signals representative of outline data stored in said outline data storage means;

determining means for determining the order in which the sets of embroidery stitches selected by said selecting means are to be sewn, based on the electrical signals representative of area order stored in said area order storage means; and stitch data changing means for changing the electrical signals representative of stitch data stored in said stitch data storage means by deleting electrical signals representative of stitch data corresponding to the set of embroidery stitches determined to be sewn first by said determining means.

8. The embroidery data producing apparatus as in claim 7, wherein the stitch changing means also changed electrical signals representative of stitch data corresponding to stitch length of an embroidery stitch which is to be formed in more than one area.

9. The embroidery data producing apparatus as in claim 7, wherein said stitch data changing means changes electrical signals representative of a portion of the stitch data stored in the stitch data storage means corresponding to the set of embroidery stitches determined to be sewn first which generates stitches in a central part of the embroidery area.

10. An embroidery data producing apparatus forming an embroidery pattern based on electrical signals representative of embroidery data, comprising:

operating means for selecting and inputting electrical signals representative of pattern data corresponding to the embroidery pattern to be formed, said pattern data including outline data for defining areas within the embroidery pattern;

memory means for storing electrical signals representative of pattern data; and processing means for creating electrical signals representative of stitch data based on the electrical signals representative of pattern data to be used as the embroidery data, the processing means including determining means for determining electrical signals representative of stitch data for each defined area, selecting means for selecting electrical signals representative of stitch data which occur in more than one defined area and deleting means for deleting the selected electrical signals representative of stitch data in one of the areas which overlap.

11. The embroidery data producing apparatus as in claim 10, wherein the operating means includes a keyboard operable by an operator.

12. The embroidery data producing apparatus as in claim 10, further comprising display means for displaying the embroidery pattern corresponding to the electrical signals representative of embroidery data.

13. The embroidery data producing apparatus as in claim 12, wherein the display means displays an outline of the embroidery pattern.

14. The embroidery data producing apparatus as in claim 10, wherein the electrical signals representative of pattern data further includes electrical signals representative of thread density data.

15. The embroidery data producing apparatus as in claim 10, wherein the electrical signals representative of pattern data include electrical signals representative of area order data corresponding to the order that the areas are to be stitched.

16. The embroidery data producing apparatus as in claim 15, wherein the deleting means deletes electrical signals representative of overlapping stitch data in relation to the order that the areas are to be stitched according to the electrical signals representative of area order data.

17. The embroidery data producing apparatus as in claim 15, wherein the deleting means deletes electrical signals representative of overlapping stitch data which will be stitched first based on the electrical signals representative of area order data.

18. The embroidery data producing apparatus as in claim 10, wherein the processing means further includes stitch changing means for changing electrical signals representative stitch data for stitches that overlap from one area into another area.

19. The embroidery data producing apparatus as in claim 18, wherein the stitch changing means truncates stitches which overlap into adjoining areas.

20. The embroidery data producing apparatus as in claim 10, wherein said deleting means partially deletes the selected electrical signals representative of stitch data in a central part of one of the areas which overlap thus leaving electrical signals representative of stitch data which generates stitches adjacent an edge of the area.

* * * * *